US010195867B2

(12) United States Patent
Bayona et al.

(10) Patent No.: US 10,195,867 B2
(45) Date of Patent: Feb. 5, 2019

(54) FIRST AND SECOND RESERVOIRS FOR PRINTABLE COMPOSITIONS

(71) Applicant: HEWLETT-PACKARD DEVELOPMENT COMPANY, L.P., Houston, TX (US)

(72) Inventors: Fernando Bayona, Terrassa (ES); Michel Georges Encrenaz, Rubi (ES); Albert Crespi, Sant Cugat del Valles (ES); Joan Albert Miravet, Sant Cugat del Valles (ES); Bhisma Hernandez Martinez, San Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/522,690

(22) PCT Filed: Nov. 14, 2014

(86) PCT No.: PCT/US2014/065672
§ 371 (c)(1),
(2) Date: Apr. 27, 2017

(87) PCT Pub. No.: WO2016/076884
PCT Pub. Date: May 19, 2016

(65) Prior Publication Data
US 2017/0313095 A1 Nov. 2, 2017

(51) Int. Cl.
*B41J 29/38* (2006.01)
*B41J 2/175* (2006.01)

(52) U.S. Cl.
CPC ..... *B41J 2/17596* (2013.01); *B41J 2/175* (2013.01)

(58) Field of Classification Search
None
See application file for complete search history.

(56) References Cited

U.S. PATENT DOCUMENTS

| | | | |
|---|---|---|---|
| 4,042,937 | A | 8/1977 | Perry et al. |
| 4,794,409 | A | 12/1988 | Cowger et al. |
| 6,935,729 | B2 | 8/2005 | De et al. |
| 7,370,923 | B2 | 5/2008 | Tanno et al. |

(Continued)

FOREIGN PATENT DOCUMENTS

| | | |
|---|---|---|
| CN | 101052529 | 10/2007 |
| CN | 101052530 | 10/2007 |

(Continued)

OTHER PUBLICATIONS

HP Scitex LX600 / LX800 Printers & HP Designjet L65500 Printer, LX610 Inks Conversion Procedures, Sep. 2011, pp. 1-44, 2nd revision, Hewlett-Packard Development Company. L.P.

*Primary Examiner* — Matthew Luu
*Assistant Examiner* — Tracey McMillion
(74) *Attorney, Agent, or Firm* — HP Inc. Patent Department

(57) ABSTRACT

An example device in accordance with an aspect of the present disclosure includes a first reservoir for a printable composition, a pump fluidically coupled to the first reservoir and a second reservoir, and a valve to prevent backflow from the second reservoir to the pump. The valve is to selectively isolate the second reservoir from the pump based on a threshold pump pressure under which the valve is to close.

15 Claims, 7 Drawing Sheets

(56) References Cited

U.S. PATENT DOCUMENTS

| | | | | |
|---|---|---|---|---|
| 8,177,313 | B2 | 5/2012 | Suzuki et al. | |
| 8,696,080 | B2 | 4/2014 | Cerro et al. | |
| 2003/0007040 | A1 | 1/2003 | Love et al. | |
| 2006/0050112 | A1 | 3/2006 | Moynihan | |
| 2007/0252860 | A1 | 11/2007 | Nitta et al. | |
| 2008/0055378 | A1 | 3/2008 | Drury et al. | |
| 2008/0079791 | A1 | 4/2008 | Kang et al. | |
| 2009/0021542 | A1* | 1/2009 | Kanfoush | B41J 2/175 347/6 |
| 2009/0173142 | A1* | 7/2009 | Peters | B65G 5/005 73/38 |
| 2009/0231367 | A1* | 9/2009 | Tsuchiya | B41J 2/16517 347/7 |
| 2010/0194798 | A1 | 8/2010 | Asami et al. | |
| 2011/0310143 | A1 | 12/2011 | Shmuel et al. | |
| 2012/0268507 | A1* | 10/2012 | Asami | B41J 2/175 347/6 |
| 2012/0281035 | A1 | 11/2012 | Uptergrove | |
| 2012/0299989 | A1 | 11/2012 | Prothon et al. | |
| 2013/0242005 | A1 | 9/2013 | Iwata | |
| 2013/0286062 | A1 | 10/2013 | Cyman, Jr. et al. | |
| 2014/0240406 | A1 | 8/2014 | LaCaze et al. | |

FOREIGN PATENT DOCUMENTS

| | | |
|---|---|---|
| CN | 101121324 | 2/2008 |
| CN | 101229717 | 7/2008 |
| CN | 101817263 | 9/2010 |
| CN | 102189808 | 9/2011 |
| CN | 103982304 | 8/2014 |
| JP | 2003-237104 | 8/2003 |
| JP | 2007-223278 | 9/2007 |
| JP | 2008-512272 | 4/2008 |
| JP | 2012-223971 | 11/2012 |
| WO | WO-2014154833 | 10/2014 |

* cited by examiner

FIRST AND SECOND RESERVOIRS FOR PRINTABLE COMPOSITIONS

BACKGROUND

Devices, such as printers, may be used for extended production runs, resulting in increased need to halt production to change empty ink supplies. Furthermore, devices may be exposed to undesirable situations, such as shocks received during shipment and/or use, issues with subassembly failure, parts becoming disconnected, damage to electronics, and so on that may result in a failure condition.

BRIEF DESCRIPTION OF THE DRAWINGS/FIGURES

DETAILED DESCRIPTION

Examples described herein enable refills to be performed more efficiently (e.g., without a need to halt pumping), and enable diagnostics to be performed during device operation to assess device status. In an example, a printer may test and check various parameters without needing to stop a refilling procedure, thereby increasing printer usage and reducing down times. Example printers also have the capability to recognize and self-diagnose system behaviors (including passive components/subsystems), and generate clear failure mode messages to facilitate failure assessment and preventive maintenance. Smart failure recognition (e.g., that doesn't need user intervention), as described herein regarding various example devices, increases printer availability/productivity, enhancing efficiency, consistency, and cost savings.

Figure 1:
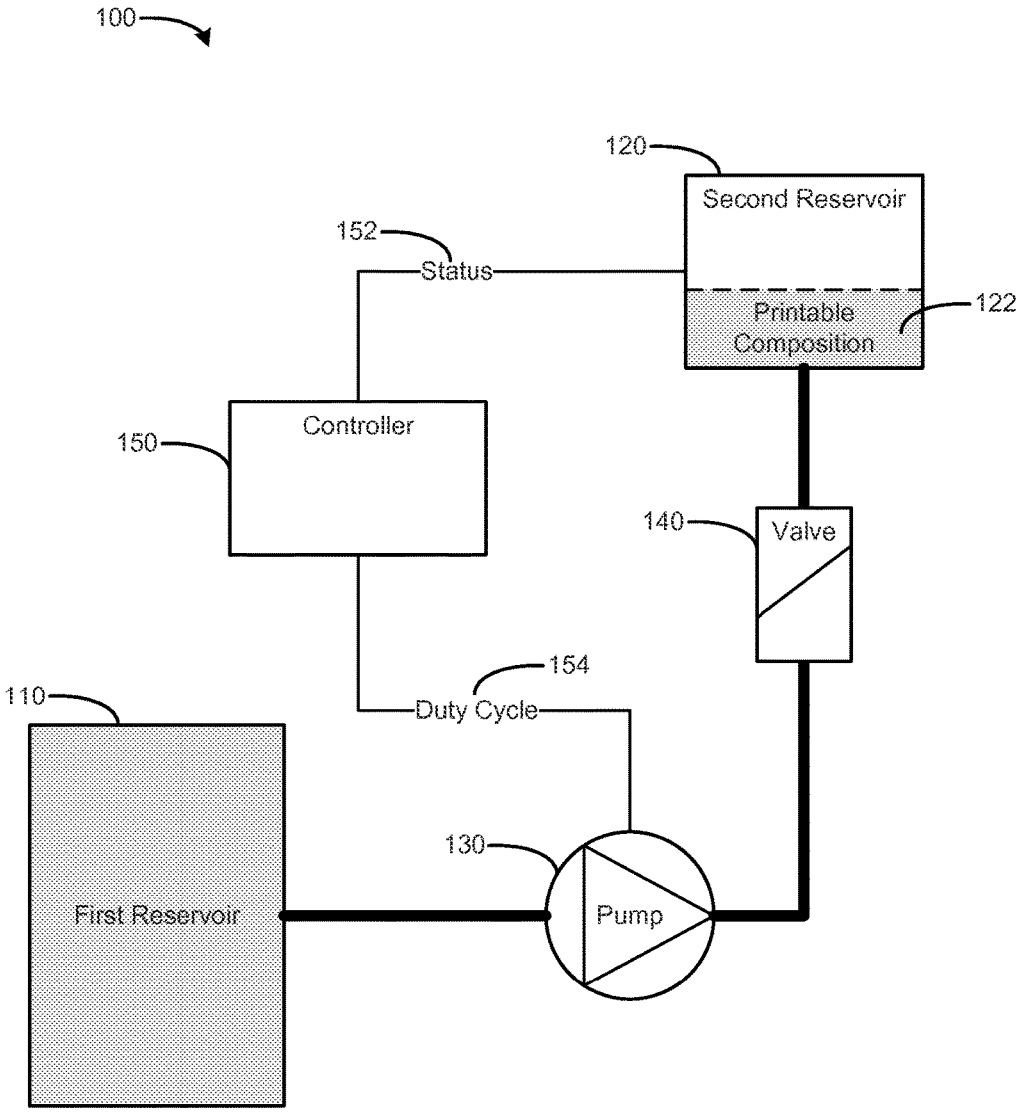
FIG. 1 is a block diagram of a device including a first reservoir and a second reservoir according to an example.

FIG. 1 is a block diagram of a device 100 including a first reservoir 110 and a second reservoir 120 according to an example. The device 100 also includes a pump 130, a valve 140, and a controller 150. The first reservoir 110 is fluidically coupled to the second reservoir 120 via the pump 130 and the valve 140. The first and second reservoirs 110, 120 are to provide and/or store a printable composition 122. The controller 150 is to identify a status 152 of the second reservoir 120, and selectively cause the pump 130 to operate according to a duty cycle 154.

The example device 100 may be a printer having a plurality of reservoirs to handle a type of the printable composition 122, such as a color of ink. Thus, a device 100 may include a plurality of types of printable composition 122, and a type of the printable composition 122 may be associated with a pump 130 and valve 140 to fluidically couple the first reservoir 110 to the second reservoir 120. The printable composition 122 may thereby be pumped from the first reservoir 110 serving as a source of printable composition 122, to refill the second reservoir 120 according to the pump 130. Further, a pump 130 may include a plurality of inlets and outlets to provide pumping for a plurality of first reservoirs 110 and second reservoirs 120 (e.g., the pump 130 may be a peristaltic pump to drive a bank of different colored inks). The example device 100 may include a tub (not shown) to enclose the first reservoir(s) 110 and contain any leakage of the printable composition. The device 100 includes a hydraulic system topology, whereby the second reservoir 120 may be positioned at a greater height than the first reservoir 110 to enable the valve 140 to affect fluid flow of the printable composition 122. Portions of device 100 upstream of the valve 140 may be referred to herein as a first hydraulic portion, and portions of device 100 downstream of the valve 140 may be referred to herein as a second hydraulic portion.

The first reservoir 110 may serve as a source of the printable composition 122. For example, the first reservoir 110 may supply a relatively large volume of printable composition 122, which is used to refill the relatively smaller second reservoir 120. In an example, the first reservoir 110 may be provided as a 3000 cubic centimeter (cc) ink cartridge, installed at the device 100 and enabling enhanced autonomy due to its large capacity, to avoid a frequent need to replace/replenish the printable composition 122.

The second reservoir 120 may hold the printable composition 122 for printing. In an example, the second reservoir 120 may be provided as a refillable ink cartridge having a relatively smaller capacity (e.g., 775 cc) than the first reservoir 110. In an alternate example, the second reservoir 120 may be provided as an inkjet cartridge including a print head, which is fluidically coupled to the first reservoir 110 for refills.

The first and second reservoirs 110, 120 may be positioned at different locations in the device 100. For example, the first reservoir 110 may be positioned out of the way in a lower part of the device 100, in a location convenient for catching ink spillage that would make its way downward. The printable composition 122 may be pumped by the pump 130, through the valve 140, to refill the second reservoir 120 as the printable composition 122 is exhausted by printing. Thus, the second reservoir 120 may serve as an intermediate storage tank to accommodate printing (e.g., oscillating back and forth along with a print head of an inkjet printer device), which may be refilled from the first reservoir 110.

The printable composition 122 may be an ink, pigment, dye, toner, sintering powder, or other printable composition, including compositions compatible with two-dimensional (2D) and three-dimensional (3D) printing technologies. In an example, the printable composition 122 may be a fluid ink compatible with inkjet printing technology.

The valve 140 may include at least one passive component related to fluidic control of the printable composition 122. Accordingly, the controller 150 may infer a status of the valve 140 indirectly, e.g., based on a status of the pump 130 and/or the second reservoir 120. The valve 140 may provide passive mechanical insulation between various systems of the device 100, such as the pump 130 and first reservoir 110 assembly, and the second reservoir 120 and associated mechatronics/assemblies (e.g., print head and carriage). In alternate examples, the valve 140 may include active component(s) that may be directly monitored/controlled by the controller 150.

The valve 140 may include a directional valve (e.g., a check valve) to prevent backflow and provide selective fluidic isolation, and a relief valve to prevent overpressure conditions. The valve 140 thereby may prevent backflow of printable composition 122 from the second reservoir 120 to the first reservoir 110, e.g., when the pump 130 is slowed and/or stopped. Further, to avoid overpressure, e.g., from a malfunction in the pump 130 or a clog in the lines/print head etc., the relief valve portion of valve 140 may open and allow printable composition 122 to controllably escape (e.g., drip downward into a catch receptacle/tub enclosing the first reservoir 110).

The pump 130 may be compatible with pumping the printable composition. In some examples, the pump 130 may be an eccentric diaphragm pump. The pump 130 may controlled by the controller 150, by selectively applying power according to duty cycle 154. In an example, the controller 150 may power a pump driver (not specifically shown, may be incorporated in the controller 150 and/or the pump 130) using a high voltage rail (e.g., 12 volts or 24 volts), in contrast to a power supply voltage rail (e.g., 3.3 volts) to supply power for, e.g., logic control. The pump driver may include a two-step switch, such as metal-oxide semiconductor field-effect transistors (MOSFETs) and/or low power transistors (bipolar junction transistors (BJT)) to provide pulse-width modulated (PWM) signals generated by the controller 150 for controlling the pump 130 via duty cycle 154. In some examples, the controller 150 may apply pump voltage to the pump 130 based on the example formula Vpump=(Duty cycle)*V1, where V1 is the high voltage rail value. Additional circuitry (e.g., transistor(s)) may be used to adapt signals/voltages from the high voltage rail to the power supply voltage rail and vice versa.

The controller 150 may provide controlled transfer of printable composition 122 from the first reservoir 110 to the second reservoir 120, e.g., by controlling the pump 130 via duty cycle 154, and/or by identifying a status 152 of the second reservoir 120. The controller 150 may include and/or refer to a table of stored values corresponding to acceptable status 152 and duty cycle 154 values, including voltages, currents, and pressures corresponding to the pump 130 and/or second reservoir 120. Thus, the controller 150 may identify existing sensed values, compare them to stored/desired values, and adjust accordingly to ensure the controlled refill of the second reservoir 120. Additionally, the controller 150 may identify values for diagnostic purposes, such as identifying whether there is a malfunction with the pump 130, valve 140, or the reservoirs 110, 120. For example, the controller 150 may identify combinations of values that contradict each other, such as a high pump voltage and/or current, but a low resulting pressure.

The duty cycle 154 may be varied to optimize refilling of the second reservoir 120. For example, the controller 150 may detect that a new/filled first reservoir 110 is connected, and that the second reservoir 120 is empty. Thus, the controller 150 may initially pump the printable composition 122 to the second reservoir 120 at high rate based on a first duty cycle 154. After some time, the controller 150 may reduce the pumping rate to a low value for a short time, according to a second duty cycle 154. During the reduced pump rate of the second duty cycle 154, the valve 140 may close and isolate the second hydraulic portion, such that the controller 150 may check a status 152 of the second reservoir 120. Because of the reduced mechanical and/or electrical noise associated with the valve isolation from the second duty cycle 154, the controller 150 may quickly obtain a clean status 152 measurement (e.g., in contrast to a noisy and/or slower measurement signal that may otherwise be affected by heavy pumping). For example, during operation of the pump 130 according to the second duty cycle 154, the controller 150 may identify how munch printable composition 122 is in the second reservoir 120 (e.g., a fill status of the second reservoir 120). If the controller 150 detects there is relatively more empty space remaining in the second reservoir 120, the controller 150 may increase the pumping rate to an intermediate (e.g., a third duty cycle 154) or high (e.g., first duty cycle 154) rate for some time. This approach may be repeated, adjusting the pump rate according to a duty cycle to maximize filling speed where appropriate, and maximize control where appropriate. For example, when the status 152 indicates that there is a relatively small amount of room remaining as the second reservoir 120 become full, the controller 150 may operate the pump 130 according to a slow duty cycle 154, to avoid risk of overpressure and/or ink spillage out of the relief valve portion of the valve 140. In examples, the controller 150 may control/trigger the pump 130 based on using drop counting information, to track ink consumption and usage from the second reservoir 120. In alternate examples, the pump 130 may be controlled based on other techniques besides duty cycle 154, such as amplitude modulation, frequency modulation, pulse-width modulation, and other approaches (e.g., analog voltage and/or current controllers).

Figure 2:
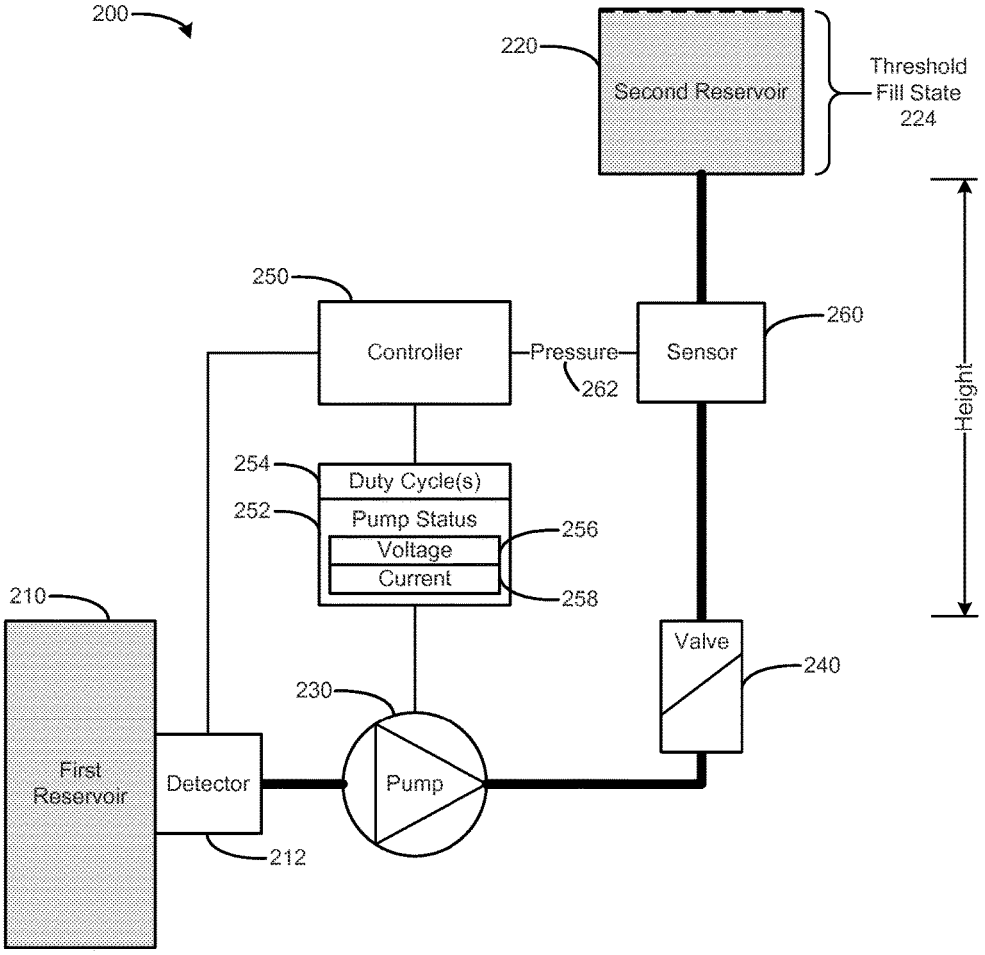
FIG. 2 is a block diagram of a device including a first reservoir and a second reservoir according to an example.

FIG. 2 is a block diagram of a device 200 including a first reservoir 210 and a second reservoir 220 according to an example. The second reservoir 220 is associated with a threshold fill state 224. The device 200 also includes a detector 212, a pump 230, a valve 240, a controller 250, and a sensor 260. The first reservoir 210 is fluidically coupled to the second reservoir 220 via the pump 230 and the valve 240. The detector 212 may indicate whether the first reservoir 210 is coupled to the device 200. The controller 250 is to identify a pressure 262 associated with the second reservoir 220, as indicated by the sensor 260, and identify a pump status 252 based on a voltage 256 and/or a current 258. The controller 250 is to selectively cause the pump 230 to operate according to a duty cycle 254.

The detector 212 may perform presence detection of the first reservoir 210. In an example, the detector 212 may be provided as a mechanical switch including a voltage divider that may be embedded in a switch controller at the detector 212 (and/or may be incorporated in controller 250). The presence detection provided by detector 212 may enable a hardware protection, e.g., to prevent the pump 230 from pumping air into the ink tubes when the first reservoir 210 is not connected to the device 200. Thus, lack of detection by detector 212 may be used to halt pumping operations or other (e.g., diagnostic) activities, and a message may be issued for the first reservoir 210 to be connected in order to proceed.

The controller 250 may identify a status of various components/systems of device 200, including whether they work properly, whether the first reservoir 210 is connected, whether the first reservoir 210 and/or the second reservoir 220 have ink, whether the pump 230 and/or valve 240 are malfunctioning, and so on. In examples, the controller 250 may identify the pressure 262 based on sensor 260 installed in the device 200, according to whether the pump 230 is pumping or not, and the corresponding different pressure sensor signals. A type of signal from the sensor 260 may be expected according to pump status 252 (e.g., a pressure in the ink tubes, based on how the pump 230 is being operated according to a voltage and/or current), and if that signal is identified, the controller 250 may determine that the device 200 is working properly. However, if a signal from the sensor 260 is not expected in view of the status of the various other systems, the controller 250 may identify an issue, even if the issue is caused by components that are not directly monitored (e.g., passive components of the valve 240) by the controller 250.

The sensor 260 may be used to identify the status of the second reservoir 220 based on pressure 262 that develops in the lines leading to the second reservoir 220. Thus, as printable media (e.g., ink) is pumped into the second reservoir 220, pressure 262 develops accordingly. Further, a height of the second reservoir 220, relative to the device 200, the sensor 260, the first reservoir 210, etc., may be established by the device 200. The height (as well as the relative position of the sensor 260) may be factored into the status identification performed by the controller 250. For example, the controller 250 may identify whether the second reservoir 220 is empty and should be filled rapidly, is approaching a threshold fill state 224 and should be filled more slowly, or has reached the threshold fill state 224 and should not be filled any more.

The sensor 260 may be provided by various types of pressure sensors, which are compatible with identifying pressure developed by the printable composition. In some examples, the sensor also may detect whether the printable composition is undergoing movement and/or flow through the ink tubes. For example, the sensor 260 may be provided as a differential pressure sensor, whose status the controller 250 may read independently of the pump status and detector status. The sensor 260 may be mechanically insulated from the pump 230 based on operation of the valve 240. The valve 240 may be associated with a threshold pressure under which the valve 240 is to close. Thus, when the pump 230 is operated according to a duty cycle 254 that develops a pressure below the threshold pump pressure, the valve 240 may remain closed. When closed, the valve 240 may prevent printable composition, pumped from the first reservoir 210, from passing beyond the valve 240 on to the sensor 260 and/or the second reservoir 220.

The controller 250 may control the pump 230, and also may identify various characteristics of the pump 230, e.g., for diagnostic purposes. In an example, the controller 250 may identify a pump status 252 based on the current 258. The current 258 associated with the pump 230 may be obtained as an indication of current flowing through windings of the pump windings, e.g., by using a shunt resistor and instrumentation amplifier (not shown). The current 258 may be obtained in series with a pump motor driver (not shown; may be incorporated with the pump 230 and/or controller 250), and may be obtained independent of other measurements such as those for the detector 212 and the sensor 260.

Thus, the controller may perform diagnostics and check whether device systems are OK and working correctly. For example, if the printable composition is available, the pump 230 is pumping properly, and signals for pressure 262, detector 212, and pump status 252 are within expected ranges, the controller 250 also may infer that the mechanical aspects, such as the valve 240, also are working properly. In an example situation that may indicate improper status or operation, the pump status 252 may indicate operation of the pump 230, but yet the sensor 260 may indicate a lack of pressure 262. Such a situation may be consistent with a situation in at least one part of the passive components in the valve 240 (e.g., a relief valve may be stuck open, allowing pumped printable composition to spill out).

Figure 3A:
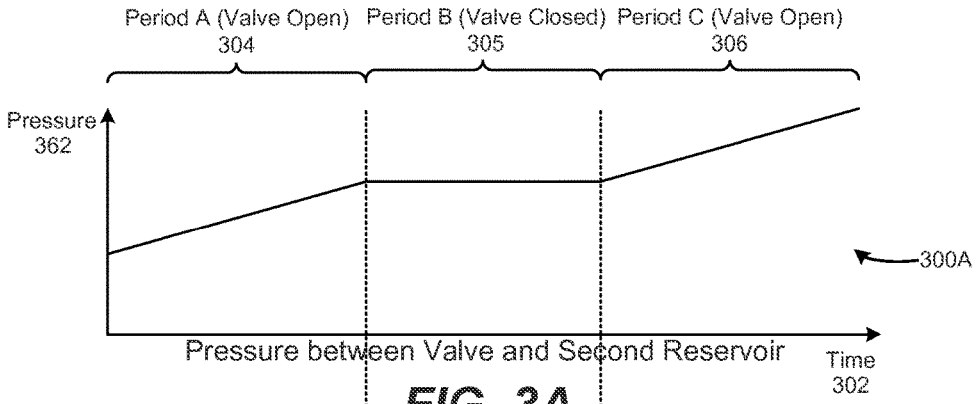
FIG. 3A is a diagram of pressure vs. time for a pressure between a valve and a second reservoir according to an example.
Figure 3B:
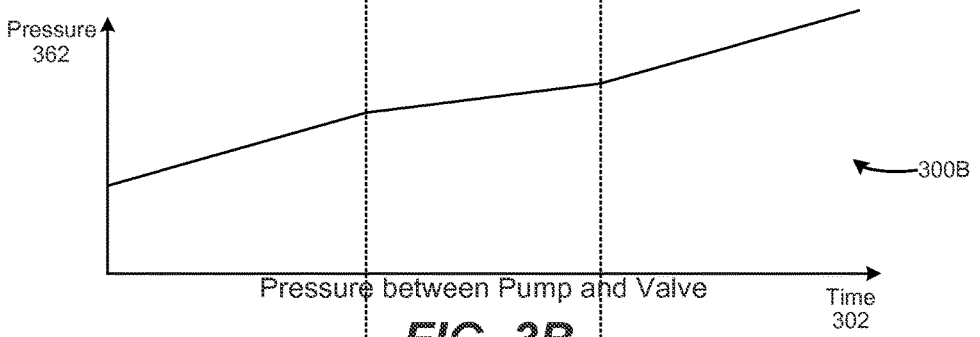
FIG. 3B is a diagram of pressure vs. time for a pressure between a pump and a valve according to an example.
Figure 3C:
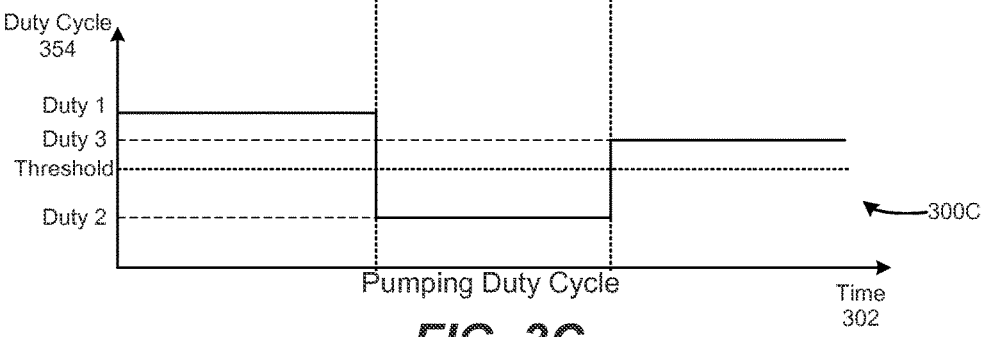
FIG. 3C is a diagram of duty cycle vs. time for a pumping duty cycle according to an example.

FIGS. 3A-3C illustrate various example scenarios, including a period A 304 corresponding to pumping duty cycle 354 of duty 1, period B 305 corresponding to duty 2, and period C 306 corresponding to duty 3. With reference to FIGS. 1 and 2, the scenarios of FIGS. 3A and 3B are shown for two hydraulic portions of an example device: FIG. 3A corresponds to a second hydraulic portion between the valve and the second reservoir, and FIG. 3B corresponds to a first hydraulic portion between the pump and the valve. Although the pressure shown in FIG. 3A may be obtained by the example pressure sensor 260, the pressure shown in FIG. 3B is illustrative (e.g., a pressure sensor for the first hydraulic portion is not specifically illustrated). A controller may selectively drive the pump according to various duty cycles 354 (for a pulse-width modulated (PWM) pump), to modulate the quantity of printable composition pumped through the hydraulic portions, from the first reservoir to the second reservoir. Notably, during a refill as indicated in FIG. 3A by the increasing pressure of the second reservoir, a device does not need to stop a printing process and interrupt productivity to perform the refill. Accordingly, productivity is enhanced.

FIG. 3A is a diagram 300A of pressure 362 vs. time 302 for a pressure between a valve and a second reservoir according to an example. Thus, the diagram 3A may indicate the reading of the pressure sensor 260 of FIG. 2 while the device is pumping and the valve 240 is operating. During period A 304, pressure increases, corresponding to fast pumping per Duty 1. For example, Duty 1 may be a relatively high duty cycle (e.g., even 100%), to provide fast pumping capability to the pump, to fill the second reservoir that may initially be empty according to the initially low pressure shown in period A 304. The pump continues to operate according to Duty 1, causing the valve to be open and the pressure between the valve and the second reservoir to increase.

After a period of time, the pump is operated at a reduced duty cycle 354 (Duty 2). By pumping slowly, the pump may continue to operate, causing printable composition to flow and build pressure behind the valve in the first hydraulic portion (as indicated in FIG. 3B). However, the pump operating at duty 2 may enable the generated pressure to remain below a threshold pressure to activate the valve, enabling the valve to be closed during period B 305 to isolate the hydraulic portion of the device downstream of the valve (e.g., the hydraulic portion including the sensor).

Thus, during period B 305, it is possible to reduce the quantity of printable media that the pump provides to the system, but without stopping pumping. Accordingly, the hydraulic portion of the device corresponding to the pressure between the valve and the second reservoir may be isolated from pumping noise (mechanical and/or electrical) by the closed valve. Accordingly, a device controller may identify various readings/measurements to check various system parameters free of noise/interference, while the device continues to pumping. Accordingly, a refill process, to fill the second reservoir, may be more efficient and finish more quickly because the device may continue working without needing to stop pumping. During period B 305, the device may identify that the sensed pressure indicates that the second reservoir has not reached a threshold fill state, and may be filled at a higher speed.

During period C (306), the device may operate the pump according to an increased duty cycle 354 (duty 3). Because duty 3 is greater than the threshold duty cycle, the valve may open in period C 306 to enable flow of the printable composition into the second reservoir. Notably, duty 3 is large enough to meet or exceed the threshold duty cycle, but does not specifically need to be greater than, equal to, or less than duty 1. The device/controller may determine a duty 3 appropriate for filling the second reservoir efficiently, in view of how much space remains in the second reservoir. For example, the duty 3 may be further reduced to avoid an overpressure situation as the second reservoir approaches a full status.

FIG. 3B is a diagram 300B of pressure 362 vs. time 302 for a pressure between a pump and a valve according to an example. FIG. 3B illustrates the pressure changes while a device is pumping, thereby increasing the pressure over time.

The pumping may be very noisy. Although illustrated as a smooth linear path, the pressure may fluctuate according to the noise (e.g., due to the mechanical nature of the pump and associated electronics). This may create difficulty when attempting to identify a pressure at a given time while the pump is operating. However, it is not necessary to stop pumping entirely, because operation of the valve enables the pump noise in the first hydraulic portion to be isolated from the sensor in the second hydraulic portion during period B 305. Accordingly, FIG. 3B illustrates the pressure continuing to increase (at a lower rate corresponding to duty 2) in the first hydraulic portion upstream from the valve as shown in FIG. 3B, while the pressure remains isolated and flat in the second hydraulic portion downstream of the valve as shown in FIG. 3A. Thus, examples described herein may save time and avoid a need to stop pumping to sense a clean/correct pressure (and other values/measurements) in the second hydraulic portion including the sensor downstream of the valve. Furthermore, the increase of pressure in FIG. 3B during period B 305 may be recaptured/transferred to the second hydraulic portion during period C 306, when the valve opens, further reducing refill times. Thus, while the pressure builds in the first hydraulic portion between the pump and valve during period B 305 and printable composition continues to flow, the controller may take noise-free measurements in the second hydraulic portion to identify a fill status of the second reservoir. For example, the controller may identify whether to pump faster or slower, to optimize the time needed for refilling because period B 305 corresponds to continuing to provide printable media to the system as shown in FIG. 3B, instead of stopping the pumping.

FIG. 3C is a diagram 300C of duty cycle 354 vs. time 302 for a pumping duty cycle according to an example. Duty2 is shown as being less than Duty 1 and/or Duty 3, and Duty 3 may be higher than, equal to, or lower than Duty 1. Duty cycles may correspond to PWM of driving a motor of the pump, which may correspond to the quantity of cubic centimeters that the pump is delivering to the system. The Duty Cycle 354 may be used by the controller for management of the printable composition quantity.

The duties shown in FIG. 3C are for illustrative purposes, and may vary in various examples. Duty 1 may be faster or slower than the Duty 3, and Duty 2 may be lower than the threshold duty to transition the valve between open and closed states. Duty 2 may be expressed as a function of the valve, corresponding to causing the pump to stay below the open/close transition threshold pressure. Similarly, Duty 2 may be expressed as a function of the pump, to generate pressure below the threshold pressure for a given duty cycle.

The diagrams illustrated in FIGS. 3A-3C may be used for refills when the valve or other components are properly functioning. However, it is possible that the valve or other components may malfunction. Accordingly, the example devices may use diagnostic approaches to identify device status.

Figure 4A:
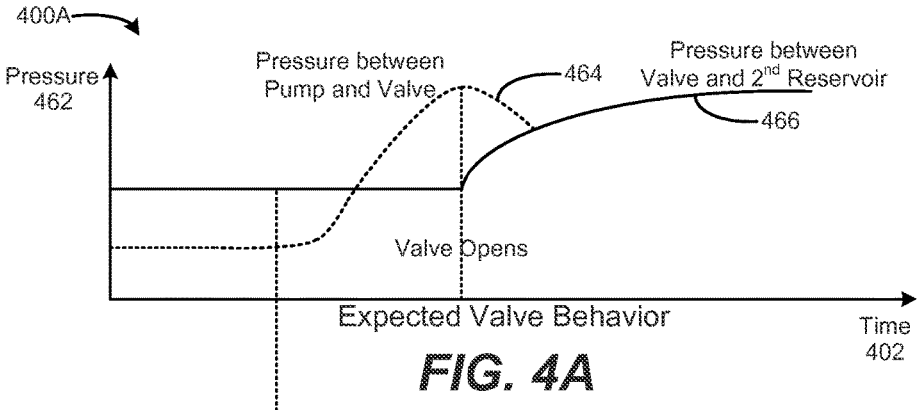
FIG. 4A is a diagram of pressure vs. time for an expected valve behavior according to an example.
Figure 4B:
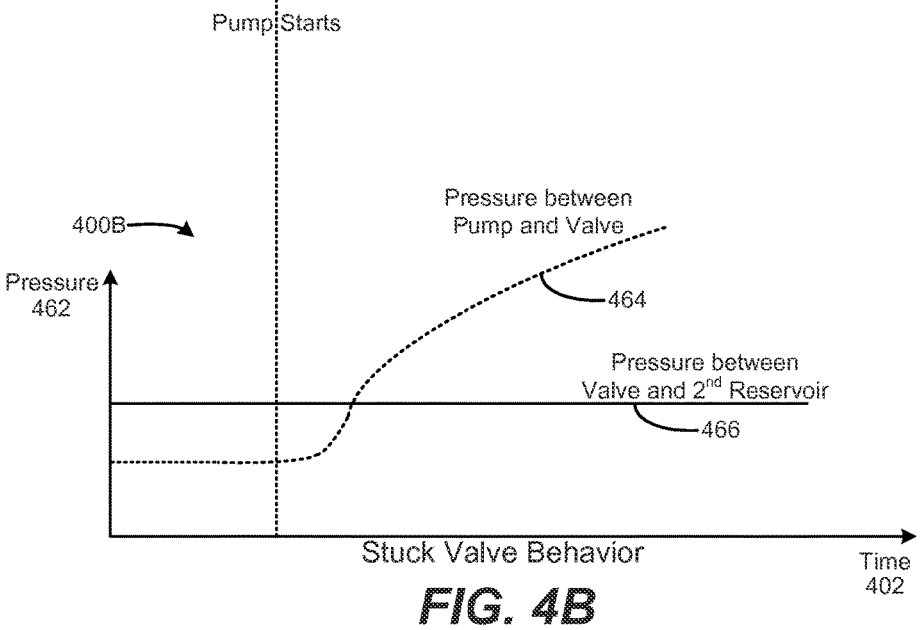
FIG. 4B is a diagram of pressure vs. time for a stuck valve behavior according to an example.

FIGS. 4A and 4B illustrate differences between expected and stuck valve behaviors, as a way for the example devices to diagnose a valve that is stuck closed. Similar approaches also may be used for other conditions, such as a relief valve that is stuck open (where pressure between pump and valve remains flat) or a pump that fails to operate (where both pressures remain flat). As illustrated, the dashed line corresponds to pressure evolution over time, for pressure in a first hydraulic portion of example devices, between the pump and the valve while pumping. The solid line corresponds to pressure evolution over time for pressure in a second hydraulic portion of example devices, between the valve and the second reservoir. Thus, the solid line may correspond to a signal from the pressure sensor 260 of FIG. 2. The controller may influence the expected pressure of the first pressure 464, corresponding to the dashed line, based on selectively controlling the pump/duty cycle. Thus, the controller may infer a status of the passive components (e.g., valve), by comparing the expected pressure of the dashed line first pressure 464 relative to the sensed solid line behavior of the second pressure 466.

FIG. 4A is a diagram 400A of pressure 462 vs. time 402 for an expected valve behavior according to an example. Initially, the first pressure 464 and the second pressure 466 are flat until the pump starts. The first pressure 464, between the pump and valve (e.g., a first hydraulic portion), as indicated by the dashed line, increases gradually. However, the second pressure 466, between the valve and the second reservoir (e.g., a second hydraulic portion), is isolated by the closed valve, and therefore doesn't see the pressure increase or the associated mechanical signal noise prior to the valve opening. After a time, the valve opens, causing the first pressure 464 to decrease, and the second pressure 466 to increase. The controller may use a reduced duty cycle, such as duty 3 shown in FIG. 3C, to slowly apply pressure (using a low PWM for the pump) with the valve open, and gradually increase pressure in second hydraulic circuit between the valve and the second reservoir (as indicated by the pressure sensor). Also, the behavior shown in FIG. 4A demonstrates how pressure may be transferred from one hydraulic portion of the device to the other. Accordingly, the examples provided herein may take advantage of pressure that can accumulate in the first hydraulic portion during a refill or diagnostic period where the pump is not fully stopped but the valve is closed, because the pressure eventually may be transferred to the second hydraulic portion when the valve opens, to contribute to filling the second reservoir.

FIG. 4B is a diagram 400B of pressure 462 vs. time 402 for a stuck valve behavior according to an example. In the case of a stuck valve, the first pressure 464 as indicated by the dashed line will continue increasing, while the second pressure 466 indicated by the solid line will remain flat. More specifically, the stuck valve prevents printable composition from passing from the first hydraulic portion to the second hydraulic portion. The controller may identify that the pump is operating due to the directly monitored pump status (e.g., based on voltage and/or current), and identify that the second pressure 466 remains flat based on the sensor readings. The controller also may confirm that the printable composition source (e.g., the first reservoir) is detected and connected to the device properly. Thus, in view of the observed statuses, the controller may infer that the passive valve is stuck, and take action to resolve the issue (e.g., halt the pump and/or issue a notification for service needed).

Figure 5:
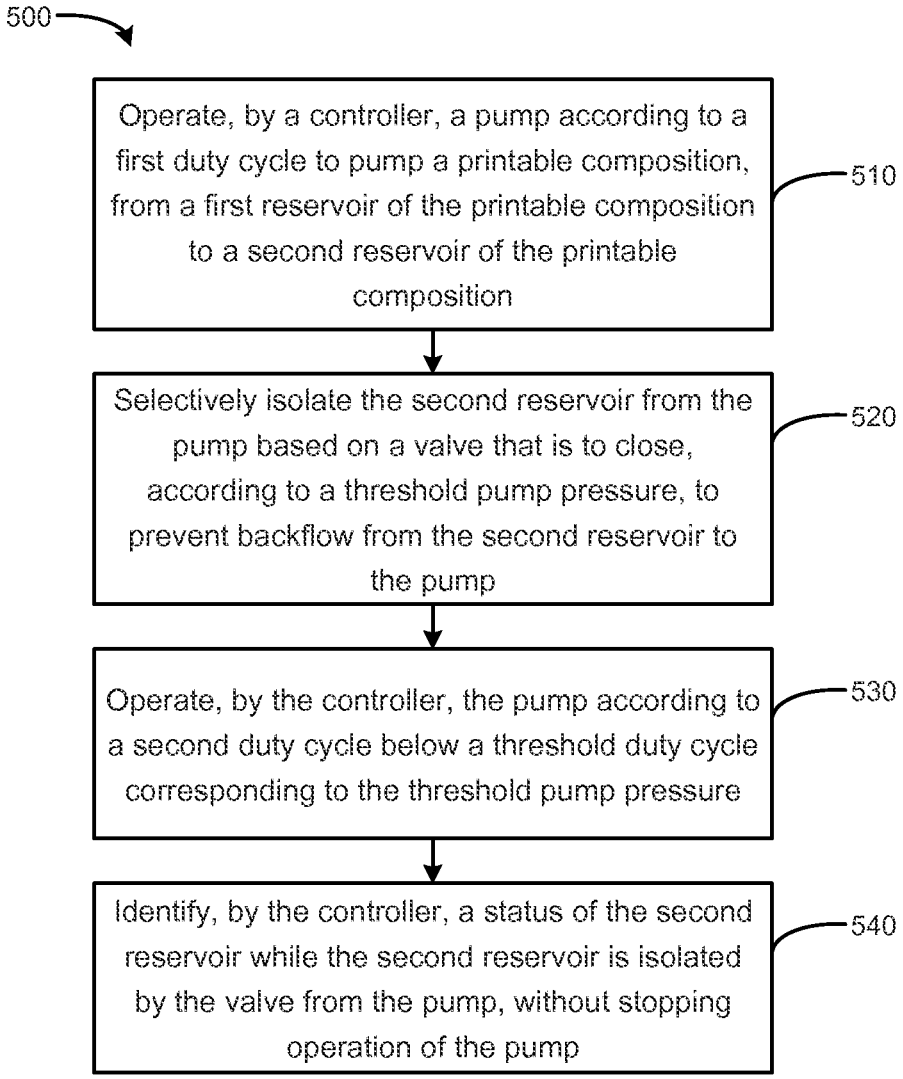
FIG. 5 is a flow chart based on identifying reservoir status according to an example.
Figure 6:
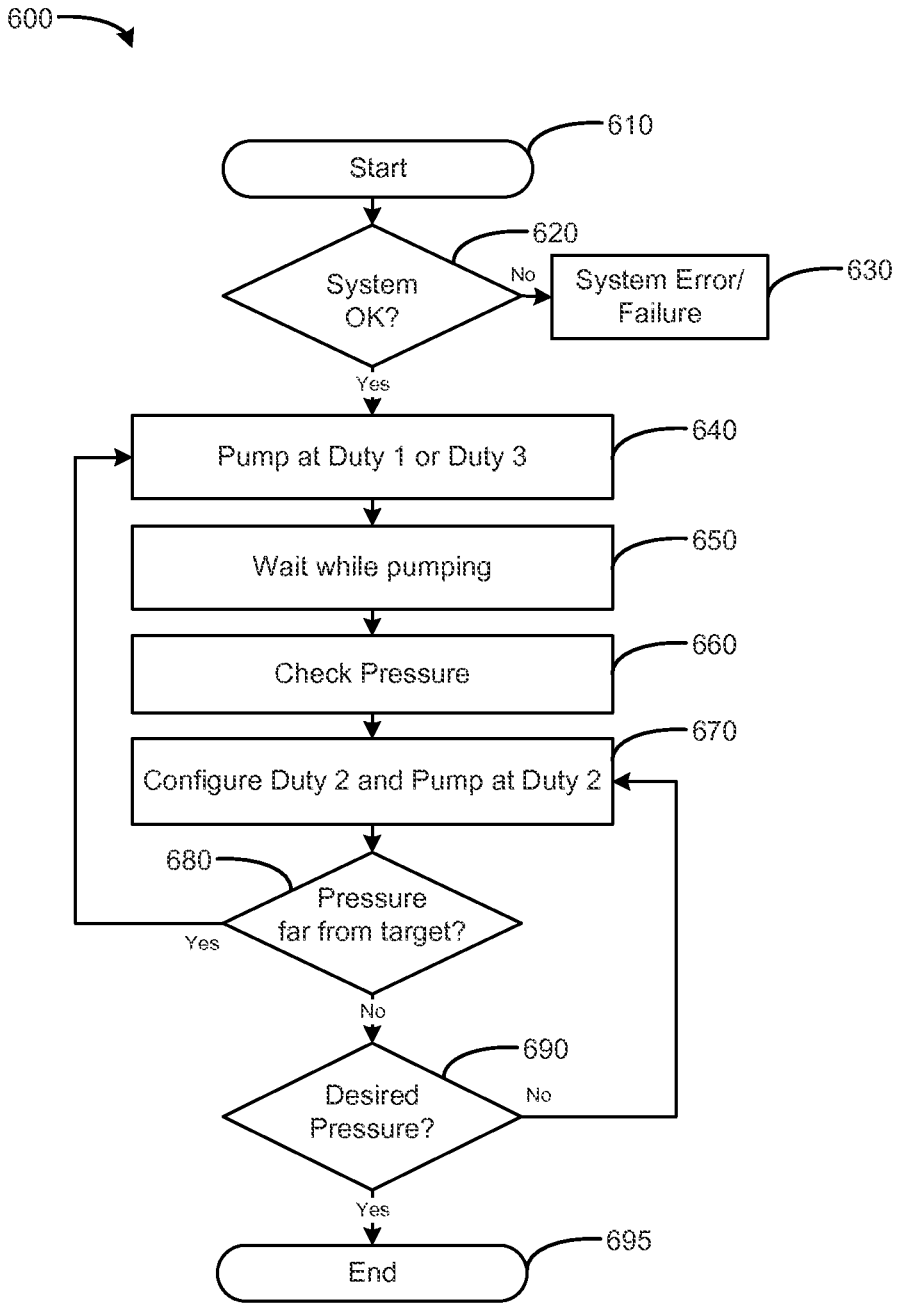
FIG. 6 is a flow chart based on identifying a desired pressure according to an example.
Figure 7:
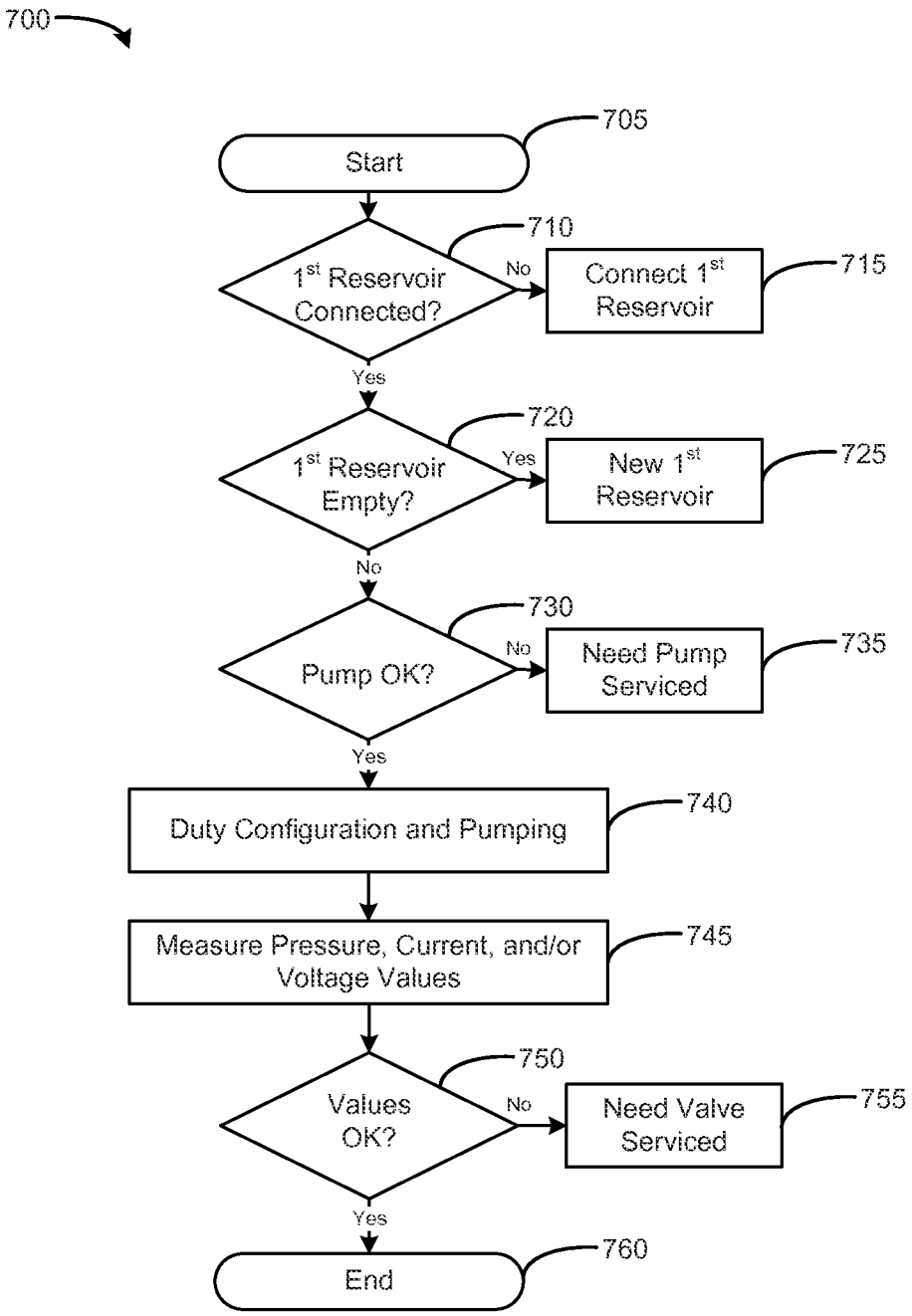
FIG. 7 is a flow chart based on identifying system status according to an example.

Referring to FIGS. 5-7, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 5 is a flow chart 500 based on identifying reservoir status according to an example. In block 510, a controller is to operate a pump according to a first duty cycle to pump a printable composition, from a first reservoir of the printable composition to a second reservoir of the printable composition. For example, the first duty cycle may be relatively high to initially fill the empty second reservoir quickly, by pumping ink from the first reservoir to the second reservoir. In block 520, the second reservoir is selectively isolated from the pump based on a valve that is to close, according to a threshold pump pressure, to prevent backflow from the second reservoir to the pump. For example, the controller may cause the pump to operate according to a reduced duty cycle, enabling the valve to close based on the valve closure strength exceeding the pump pressure developed according to the reduced duty cycle. In block 530, the controller is to operate the pump according to a second duty cycle below a threshold duty cycle corresponding to the threshold pump pressure. For example, the second duty cycle may be low enough to allow the valve to close, but large enough to continue developing pressure in a first hydraulic portion of the device. In block 540, the controller is to identify a status of the second reservoir while the second reservoir is isolated by the valve from the pump, without stopping operation of the pump. For example, the pump may continue developing pressure in the first hydraulic portion without causing noise in the second hydraulic portion, which includes a sensor used to identify a fill status of the second reservoir. This process may be repeated until the second reservoir is full, and the various duty cycles may be varied to avoid risk of overpressure as the second reservoir approaches a full status.

FIG. 6 is a flow chart 600 based on identifying a desired pressure according to an example. Flow begins at block 610. In block 620, a system check is performed to identify whether the system is OK. For example, the system may verify various default readings, such as a pressure sensor output, pump status, and detection of the first reservoir. If the system is not OK, flow proceeds to block 630. In block 630, flow halts with a system error/failure condition. For example, the system may generate a message displayed at the device, and/or generate a call for service. If, at block 620, the system is OK, flow proceeds to block 640. In block 640, the system is to pump at duty cycle 1 or duty cycle 3. For example, the system may pump at an increased rate corresponding to Duty 1, which may cause the pressure sensor to register large amounts of noise due to the pumping. In block 650, the system is to continue pumping for a wait time. For example, the amount of pumping wait time may be a predetermined period, or a varying interval, and so on according to particular system needs and reservoir/pump capacities. After pumping for some time, the system may check how much ink has been pumped into the second reservoir. The amount of ink may correspond to a sensed pressure. In block 660, the system is to check the pressure. For example, a controller of the system may identify a pressure sensor reading, and look up a fill status of the second reservoir according to a lookup table correlating pressures to fill status. In block 670, the system is to configure duty cycle 2 and pump at duty cycle 2. For example, duty cycle 2 may be chosen to cause the pump to operate below a threshold pressure associated with valve opening. Thus, the pump may continue operating and developing pressure in the corresponding first hydraulic portion, while the valve isolates the second hydraulic portion from mechanical pumping noise thereby avoiding anomalous pressure sensor readings. In block 680, the system is to identify whether the sensed pressure is far from a target pressure (e.g., a target pressure associated with a fill state of the second reservoir). For example, the system may sense a pressure indicating that the second reservoir is only half full, enabling the controller to determine that there is a large margin remaining for use of full speed pumping. If yes the pressure is far from the target, flow returns to block 640 to continue pumping at a higher duty cycle associated with duty cycle 1 or duty cycle 3. Depending upon how full the second reservoir is, and how much of a margin remains until the reservoir is filled, the system may choose to use duty 1 again, or perhaps a different and/or reduced duty (e.g., duty 3) in order to optimize refill speeds without risking overpressure as filled status approaches. If, at block 680 the pressure is not far from target, flow proceeds to block 690. In block 690, the system is to identify whether a desired pressure has been reached (e.g., the fill state). For example, the controller may compare the pressure sensor reading to a table of sensor readings that include a pressure corresponding to a fill state of the second reservoir. If not desired pressure, flow proceeds to block 670 where pumping proceeds at the gradual duty 2 rate (e.g., in view of the proximity to a full state). If desired pressure is reached at block 690, flow ends at block 695.

FIG. 7 is a flow chart 700 based on identifying system status according to an example. Flow begins at block 705. In block 710, it is determined whether the first reservoir is connected. For example, the controller may identify the status of a mechanical detector at the interface for the first reservoir. If not connected, flow proceeds to block 715. In block 715, a directive is issued to connect the first reservoir. For example, the device may display a message on the printer, or issue a notification to the network etc. If, in block 710, the first reservoir is connected, flow proceeds to block 720. In block 720, it is determined whether the first reservoir is empty. For example, the controller may operate the pump at a given duty cycle and check the status of the pump and whether the pump experiences a load (ink present) or not (ink empty). If empty, flow proceeds to block 725. In block 725, a directive is issued to provide a new first reservoir. For example, the device may display a message on the printer, or issue a notification to the network etc. If, in block 720, the first reservoir is not empty, flow proceeds to block 730. In block 730, it is determined whether the pump is OK. For example, the controller may issue a known duty cycle to the pump, and check the response of the pump based on a pump status. If not OK, flow proceeds to block 735. In block 735, a directive is issued that pump service is needed. For example, the device may display a message on the printer, or issue a notification to the network etc. If, in block 730, it is determined that the pump is OK, flow proceeds to block 740. In block 740, duty configuration and pumping are established. For example, the controller may identify whether to use a duty 1, duty 2, or duty 3 according to the various examples set forth above. In block 745, pressure, current, and/or voltage values are measured. For example, the controller may directly monitor the pump status to obtain the current/voltage values, and directly monitor the pressure sensor to obtain the pressure values. In block 750, it is determined whether the values are OK. For example, the controller may check for anomalous or contradictory values (e.g., pumping at full duty cycle, but sensing zero pressure), or check for stuck components as set forth above. If not OK, flow proceeds to block 755. In block 755, a directive is issued that valve service is needed. For example, the device may display a message on the printer, or issue a notification to the network etc. If, at block 750, the values are OK, flow ends at block 760.

Thus, example devices may assess active/monitored components, as well as infer the status of passive components (such as a valve failure). An example printer may test for unexpected behavior and provide feedback regarding passive subassemblies/systems. By providing proactive warnings as soon as issues are detected, technical support costs may be minimized with enhanced ability to save time and money in view of example devices providing proactive and clear failure/issue messages.

Examples provided herein may be implemented in hardware, software, or a combination of both. Example systems can include a processor and memory resources for executing instructions stored in a tangible non-transitory medium (e.g., volatile memory, non-volatile memory, and/or computer readable media). Non-transitory computer-readable medium can be tangible and have computer-readable instructions stored thereon that are executable by a processor to implement examples according to the present disclosure.

An example system (e.g., a computing device) can include and/or receive a tangible non-transitory computer-readable medium storing a set of computer-readable instructions (e.g., software). As used herein, the processor can include one or a plurality of processors such as in a parallel processing system. The memory can include memory addressable by the processor for execution of computer readable instructions. The computer readable medium can include volatile and/or non-volatile memory such as a random access memory ("RAM"), magnetic memory such as a hard disk, floppy disk, and/or tape memory, a solid state drive ("SSD"), flash memory, phase change memory, and so on.

What is claimed is:

1. A device comprising:

a first reservoir to serve as a source of a printable composition;

a pump fluidically coupled to the first reservoir and a second reservoir to pump the printable composition from the first reservoir to the second reservoir, wherein the second reservoir is to store the printable composition;

a valve fluidically coupled to the pump and the second reservoir, to prevent backflow from the second reservoir to the pump, and to selectively isolate the second reservoir from the pump based on a threshold pump pressure under which the valve is to close; and a controller to cause the pump to operate below a threshold duty cycle corresponding to the threshold pump pressure, and to identify a status of the second reservoir while the second reservoir is isolated from the pump by the valve, without stopping operation of the pump, wherein the controller is to operate the pump according to a first duty cycle based on a first status of the second reservoir, and operate the pump according to a second duty cycle based on a second status of the second reservoir, wherein the first duty cycle is greater than the second duty cycle.

2. The device of claim 1, further comprising a sensor to identify a pressure associated with the printable composition, and wherein the controller is to identify the status of the second reservoir based on the pressure.

3. The device of claim 2, wherein the second reservoir is to be positioned at a greater height relative to the valve and the first reservoir, and wherein, while the second reservoir is isolated by the valve from the pump, the pressure identified by the sensor is to correspond to a fill state of printable composition in the second reservoir.

4. The device of claim 2, wherein the controller is to diagnose the valve based on the pressure and a pump status, wherein the pump status is based on at least one of a pump voltage and pump current.

5. The device of claim 1, wherein the controller is to identify the status, and the second status indicates a second fill state of the second reservoir than a first fill state associated with the first status.

6. The device of claim 5, wherein the second duty cycle is below the threshold duty cycle, and the controller is to operate the pump according to the second duty cycle in response to identifying the status corresponding to the second reservoir approaching a threshold fill state.

7. The device of claim 6, wherein the controller is to determine a first time period to operate the pump according to the first duty cycle, and a second time period to operate the pump according to the second duty cycle, based on a difference between the status of the second reservoir and the threshold fill state.

8. The device of claim 1, further comprising a detector to indicate to the controller that the first reservoir is coupled to the pump.

9. A device comprising:

a first reservoir to serve as a source of a printable composition;

a second reservoir to store the printable composition, wherein the second reservoir is positioned at a greater height relative to the first reservoir;

a pump fluidically coupled to the first reservoir and to the second reservoir;

a valve fluidically coupled to the pump and the second reservoir, to prevent backflow from the second reservoir to the pump, and to selectively isolate the second reservoir from the pump based on a threshold pump pressure under which the valve is to close; and a controller to cause the pump to operate according to a first duty cycle to pump the printable composition from the first reservoir to the second reservoir, to cause the pump to operate according to a second duty cycle below a threshold duty cycle corresponding to the threshold pump pressure, and to identify a status of the second reservoir while the second reservoir is isolated by the valve from the pump, without stopping operation of the pump.

10. The device of claim 9, further comprising a sensor to identify a pressure associated with the second reservoir, and wherein the controller is to identify the status of the second reservoir based on the pressure.

11. A method, comprising:

operating, by a controller, a pump according to a first duty cycle to pump a printable composition, from a first reservoir of the printable composition to a second reservoir of the printable composition;

selectively isolating the second reservoir from the pump based on a valve that is to close, according to a threshold pump pressure, to prevent backflow from the second reservoir to the pump;

operating, by the controller, the pump according to a second duty cycle below a threshold duty cycle corresponding to the threshold pump pressure; and identifying, by the controller, a status of the second reservoir while the second reservoir is isolated by the valve from the pump, without stopping operation of the pump.

12. The method of claim 11, further comprising identifying a difference between the status and a threshold fill state of the second reservoir, and operating the pump according to a plurality of duty cycles that are to decrease according to a corresponding decrease in the identified difference.

13. The method of claim 11, further comprising identifying a difference between the status and a threshold fill state of the second reservoir, and operating the pump according to a plurality of time periods and corresponding duty cycles, wherein the plurality of time periods are inversely proportional to the plurality of corresponding duty cycles.

14. The method of claim 11, further comprising stopping operation of the pump in response to identifying that the status is consistent with a threshold fill state of the second reservoir.

15. The method of claim 11, further comprising diagnosing that the source is unable to provide the printable composition based on a pump status according to at least one of a pump voltage and a pump current, and providing a notification to service the source.

* * * * *